US011609056B2

(12) United States Patent
Vaughan

(10) Patent No.: US 11,609,056 B2
(45) Date of Patent: Mar. 21, 2023

(54) SELECTOR FOR FIREARMS

(71) Applicant: Franklin Armory Holdings, Inc., Minden, NV (US)

(72) Inventor: Grant Vaughan, Carson City, NV (US)

(73) Assignee: FRANKLIN ARMORY HOLDINGS, INC., Minden, NV (US)

( * ) Notice: Subject to any disclaimer, the term of this patent is extended or adjusted under 35 U.S.C. 154(b) by 0 days.

(21) Appl. No.: 17/348,300

(22) Filed: Jun. 15, 2021

(65) Prior Publication Data

US 2021/0404759 A1 Dec. 30, 2021

Related U.S. Application Data

(60) Provisional application No. 63/045,770, filed on Jun. 29, 2020.

(51) Int. Cl.
*F41A 19/46* (2006.01)
*F41A 19/10* (2006.01)

(52) U.S. Cl.
CPC ..... *F41A 19/46* (2013.01); *F41A 19/10* (2013.01)

(58) Field of Classification Search
CPC ..... F41A 19/46; F41A 19/10; F41A 17/46
See application file for complete search history.

(56) References Cited

U.S. PATENT DOCUMENTS 2,512,638 A * 6/1950 Gaidos ..... F41A 19/46 42/69.01
2,539,447 A * 1/1951 Lochhead ..... F41A 19/46 89/140
4,893,547 A * 1/1990 Atchisson ..... F41A 3/72 89/187.01
6,173,518 B1 * 1/2001 Oberst ..... F41A 17/02 42/70.11
7,234,261 B2 * 6/2007 McGarry ..... F41A 17/56 42/70.05
10,466,002 B1 * 11/2019 Geissele ..... F41A 19/02
10,480,882 B2 11/2019 Fellows et al.

OTHER PUBLICATIONS hkparts.net, "HK MP7A1 Flip Front & Rear Sight Set Complete," https://hkparts.net/product/hk-mp7a1-flip-front-rear-sight-set-complete-p24.htm, (c) 2019, Accessed Jun. 22, 2020.

* cited by examiner

*Primary Examiner* — Joshua T Semick
(74) *Attorney, Agent, or Firm* — Bennet K. Langlotz; Langlotz Patent & Trademark Works, LLC

(57) ABSTRACT

Firearm control mechanisms have a frame, a trigger element connected to the frame and movable with respect to the frame, a selector connected to the frame and pivotable with respect to the frame about a pivot axis, the selector including a first cam surface operably engaged to a follower portion of the trigger element, the selector having a detent portion having a detent surface opposing a spring biased detent follower connected to the frame and operable to reciprocate against the detent surface, the detent surface having a plurality of stable positions, each corresponding to an operating condition of the fire control mechanism, and the detent portion being a body lacking any concave surfaces. The detent surface may have a plurality of flat cam surfaces. At least two of the flat cam surfaces may be perpendicular to each other. A corner may join the plurality of flat cam surfaces.

15 Claims, 15 Drawing Sheets

SELECTOR FOR FIREARMS

CROSS-REFERENCE TO RELATED APPLICATION

This application claims the benefit of U.S. Provisional Patent Application No. 63/045,770 filed on Jun. 29, 2020, entitled "SELECTOR-SELECTOR DETENT GEOMETRY," which is hereby incorporated by reference in its entirety for all that is taught and disclosed therein.

FIELD OF THE INVENTION

The present invention relates to firearms, and more particularly to a firearm control mechanism that determines the firing mode of a host firearm.

BACKGROUND AND SUMMARY OF THE INVENTION

On many firearms, there is a need to switch the firearm between several different firing modes including, but not limited to, safe, semi-automatic, multiple round burst, binary, and fully automatic. Mode changes are accomplished by rotating a selector into a selected position corresponding to the desired mode. The selector can also accomplish other functions, such as canceling a shot in binary mode and safely lowering the hammer, or preventing rotation when the trigger is oriented in certain positions. In order to keep the firearm in the user-selected mode of operation, some means of limiting or controlling the rotation of the selector must be used. A common method of controlling or limiting selector rotation to specified angles corresponding to different firing modes is a spring-loaded detent. The spring-loaded detent generally has a conical, tapered, or hemispherical tip that locks into a series of corresponding similarly shaped holes or indentations or cuts in the selector. This approach requires the manufacture of detents with specially contoured tips and also of a series of precise notches in the selector, which must be shaped such that they can cam the detent against the spring, but also can be held in place by the detent to sufficiently prevent rotational motion of the selector.

An example of a prior art selector used with a spring-loaded detent as disclosed by U.S. Pat. No. 10,480,882 to Fellows et al. is shown in FIG. 1. FIG. 1 illustrates a prior art trigger group for semi-automatic firearms 10. More particularly, the trigger group for semi-automatic firearms 10 has a hammer 12, intermittent disconnector spacer 26, disconnector 50, trigger 62, and safety selector assembly 74. When assembled, the hammer, intermittent disconnector spacer, binary disconnector, disconnector, trigger, and safety selector are connected to a housing (not shown). Apertures in the housing receive cross-pins 44, 46. The cross-pins hold the trigger group for semi-automatic firearms 10 within the lower of the firearm (not shown). The cross-pins fit through apertures in the hammer, hammer spring, trigger, trigger spring, trigger spacers 144, and the housing. The trigger spacers are attached to the trigger and keep the trigger from sliding laterally within the housing.

The hammer 12 has a top 14, bottom 16, front 18, and rear 20. The top rear of the hammer defines a curved notch 22 that is a disconnector 50 engagement surface, and the bottom rear of the hammer defines a hammer hook 24 that is a for selective engagement of the sear 72. The hammer is moveable between a cocked position and striking position, with a spring driven bias toward the striking position, and includes a front striking face to impact the firing pin (not shown) of the host firearm (not shown). The top rear 20 of the hammer defines a cam lobe that extends from the top of the hammer in the direction of the bottom rear of the firearm and interacts with a rear ramp 36 on an intermittent disconnector spacer 26.

The intermittent disconnector spacer 26 is an elongated disconnector control element having a top 28, bottom (not visible), front 32, and rear 34. In addition to the rear ramp, the intermittent disconnector spacer includes a front wedge/block portion 38 extending out transversely from the left side 106 of the intermittent disconnector spacer toward the disconnector 50, a front slot (not visible), and a rear slot (not visible). The front wedge is positioned forward of a disconnector pivot axis 102. A pin 48 is received within apertures 126 in the trigger 62 and the rear slot. The intermittent disconnector spacer has a spring-driven bias from a spring (not shown) toward the rear engaged/first control position and is oriented by the rail of the trigger 62, limited in linear travel toward the forward disengaged position by an end stop on the trigger, and limited in linear travel toward the engaged position by the safety selector assembly 74.

The rear 34 of the intermittent disconnector spacer 26 is radiused. The radiused rear can engage a selector shaft 76 of the safety selector assembly 74 at any angle as the intermittent disconnector spacer and trigger 62 rotate without causing the intermittent disconnector spacer to move longitudinally along the length of/relative to the trigger.

The front wedge 38 nestles between the trigger 62 and the disconnector 50 when the trigger is pulled far enough rearward to create a void between the disconnector forward nose end stop surface 56 and the trigger, thereby selectably intervening between a bottom 54 front contact portion of the disconnector and the trigger. The void alters the geometry of the hammer engagement surface/sear 72 of the trigger and the hammer engagement surface/forward-facing hammer retention hook 60 of the disconnector such that when the hammer 12 is released from the disconnector, the sear of the trigger will not be able to capture the hammer, thereby permitting the hammer to move to the striking position.

The rear ramp 36 on the intermittent disconnector spacer 26 is engaged by the hammer cam lobe 20 upon cocking of the hammer 12 such that if the trigger 62 is in a position that the hammer would not be captured by the trigger or disconnector 50 because of their modified geometry, or if the trigger were in any position forward of that, the intermittent disconnector spacer would be forced to its disengaged position, thereby moving the disconnector forward into position to capture the hammer to prevent hammer follow. Hammer follow could otherwise occur if the trigger were pulled far enough to fire, but not far enough for the sear to engage the hammer, while the disconnector was out of position to capture the hammer. In that circumstance, the hammer would cock when the bolt carrier group 148 cycled, but the trigger group for semi-automatic firearms 10 would have no device in position to capture the hammer, and the hammer would follow the bolt carrier group and firing pin (not shown) to the striking position, an effect regarded as an automatic function of a firearm. Since the current invention is intended for use in a semi-automatic firearm, there must be no potential for automatic function to occur. Because the intermittent disconnector spacer is automatically disengaged by normal function of the trigger group for semi-automatic firearms, there is no need for a secondary/backup disconnector to prevent hammer follow.

The disconnector 50 has a top 52, bottom (not visible), forward nose end 56, rear 58, and a central aperture (not visible). The top of the disconnector includes a forward-facing hammer retention hook 60, and the bottom rear defines a notch (not visible). A disconnector spring (not shown) has one end received within the notch in the bottom rear of the disconnector. The spring causes the disconnector to be biased to rotate clockwise towards the hammer 12 about pin 44 inserted through the aperture in the disconnector. The disconnector is moveable between an engaged position and a disengaged position, with a spring driven bias toward the engaged position. The position of the disconnector is associated directly with the position of the trigger 62, such that when the trigger is pulled far enough rearward, the disconnector is oriented in the engaged position, and when the trigger is far enough forward, the disconnector is oriented in the disengaged position. When the disconnector is in the engaged position, the hammer can move the disconnector in the direction counter its spring bias without affecting the position of the trigger. The forward-facing hook is a hammer engagement facility. The disconnector is also attached to the trigger, includes a front end stop surface that interacts with the trigger, and functions to capture the hammer when the trigger is no longer in a position to retain the hammer.

The trigger 62 has a top 64, bottom 66, front 68, rear 70, and central apertures 134. The top of the front of the trigger includes a sear 72. The intermittent disconnector spacer 26 and disconnector 50 are each planar bodies parallel to and adjacent to each other that fit in a channel 120 along the top spine of the trigger 62. In the current embodiment, the safety selector assembly 74 has a selector shaft 76 and is ambidextrous, with the lever on the left 108 being larger than the lever on the right 110. The safety selector is swappable, which enables the user to place the larger lever on the desired side of the firearm. The disconnector and sear both act as retention facilities each operable to selectively restrain the hammer in the cocked position. The trigger group for semi-automatic firearms 10 is suitable for use with an AR-15 rifle in the current embodiment.

The safety selector assembly provides the user of an associated firearm with three distinct modes: safe mode, semi-automatic mode, and binary mode. The safety selector has three cam lobe profiles 78, 86, 90 and a safety detent trough 100 extending from left 108 to right 110. Cam lobe 78 and cam lobe 90 are coplanar and act to regulate the movement of the trigger 62. Cam lobe 86 regulates the movement of the intermittent disconnector spacer 26. At no point does the disconnector 50 contact the safety selector assembly.

The intermittent disconnector spacer cam 86 has a semicircular profile at the section that engages the intermittent disconnector spacer 26 that allows the intermittent disconnector spacer 26 to move into the rearward engaged position when the safety selector assembly 74 is in binary mode, and prohibit the intermittent disconnector spacer from moving into the rearward engaged position when the safety selector assembly is in either semi-automatic mode or safe mode. The trigger relief and safety cam 78 and 90 has a full diameter section 88 that limits trigger 62 travel to distances unique to each mode position to prevent firing in safe mode.

To facilitate engagement of the intermittent disconnector spacer 26, the trigger 62 is intentionally allowed to continue being pulled even once the disconnector 50 has reached a state of maximum forward rotation by colliding with the hammer 12. If the hammer is caught on the disconnector, and the user pulls the trigger further, at about 6° of rotation the disconnector will no longer rotate forward because the hammer blocks the disconnector from doing so. However, the trigger is allowed to continue rotating another 3-4°. This creates a gap between the front 56 nose of the disconnector and the top-front 64, 68 of the trigger. When that gap is created, the spring bias of the intermittent disconnector spacer pushes the intermittent disconnector rearward (when rearward movement is allowed by the selector assembly 74) into the engaged position.

The safety detent trough 100 located on the far right side 110 of the safety selector is a shallow groove with three plunge cuts 112 spaced 90° apart. A spring-loaded safety detent (not shown) has a tip that travels in this groove and stops at each plunge cut. This feature defines the three separate modes noted above. When additional finger pressure is applied to the safety selector lever, the safety detent spring is overridden, and the safety selector travels to the next plunge cut that defines the next mode. Disadvantages to this approach are that the tapered detent tip can become worn from use and eventually not securely hold the safety selector in place, that precise machining of the conical notches and V-shaped grooves with delicate, small-tipped tooling is required, and that in the condition that the selector has been rotated to a position between notches, there is no mechanism to bias the selector toward either adjacent notch.

Therefore, a need exists for a new and improved firearm control mechanism that uses flat surfaces to reduce wear to improve ease of manufacture of both the selector and the spring-loaded detent, and to eliminate the dead zone that exists between notch positions. In this regard, the various embodiments of the present invention substantially fulfill at least some of these needs. In this respect, the trigger group for semi-automatic firearms according to the present invention substantially departs from the conventional concepts and designs of the prior art, and in doing so provides an apparatus primarily developed for the purpose of providing a firearm control mechanism that uses flat surfaces to reduce wear improve ease of manufacture of both the selector and the spring-loaded detent, and to provide a mechanism to bias the selector out of any intermediary positions between stable positions.

The present invention provides an improved firearm control mechanism, and overcomes the above-mentioned disadvantages and drawbacks of the prior art. As such, the general purpose of the present invention, which will be described subsequently in greater detail, is to provide an improved firearm control mechanism that has all the advantages of the prior art mentioned above.

To attain this, the preferred embodiment of the present invention essentially comprises a frame, a trigger element connected to the frame and movable with respect to the frame, a selector connected to the frame and pivotable with respect to the frame about a pivot axis, the selector including a first cam surface operably engaged to a follower portion of the trigger element, the selector having a detent portion having a detent surface opposing a spring biased detent follower connected to the frame and operable to reciprocate against the detent surface, the detent surface having a plurality of stable positions, each corresponding to an operating condition of the fire control mechanism, and the detent portion being a body lacking any concave surfaces on its engaging face. The detent surface may have a plurality of flat cam surfaces. At least two of the flat cam surfaces may be perpendicular to each other. A corner may join the plurality of flat cam surfaces. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
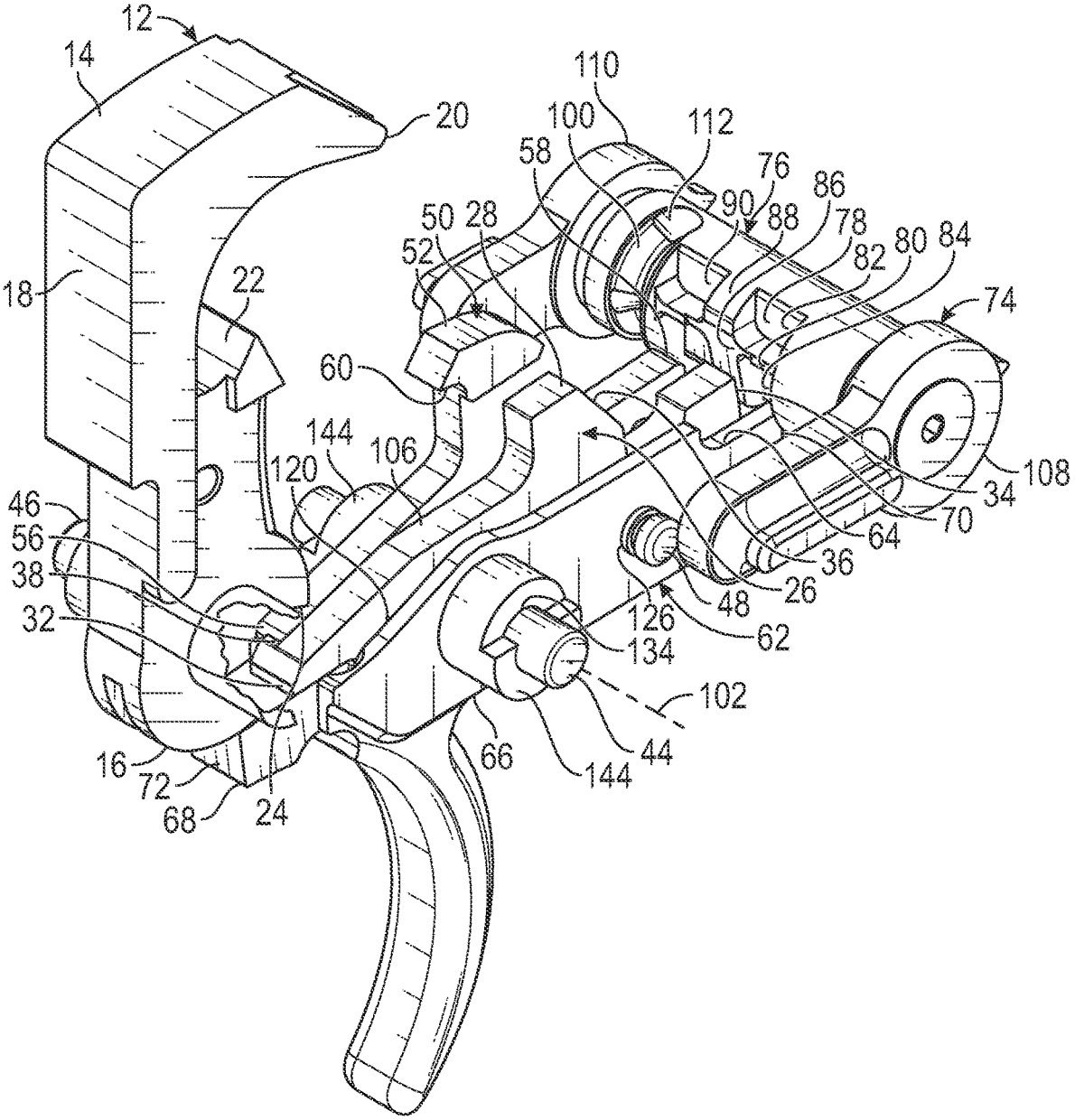
FIG. 1 (Prior Art)
FIG. 1 is a front isometric view of a prior art trigger group for semi-automatic firearms that includes a selector used with a spring-loaded detent.

An embodiment of the firearm control mechanism of the present invention is shown and generally designated by the reference numeral 200.

Figure 2:
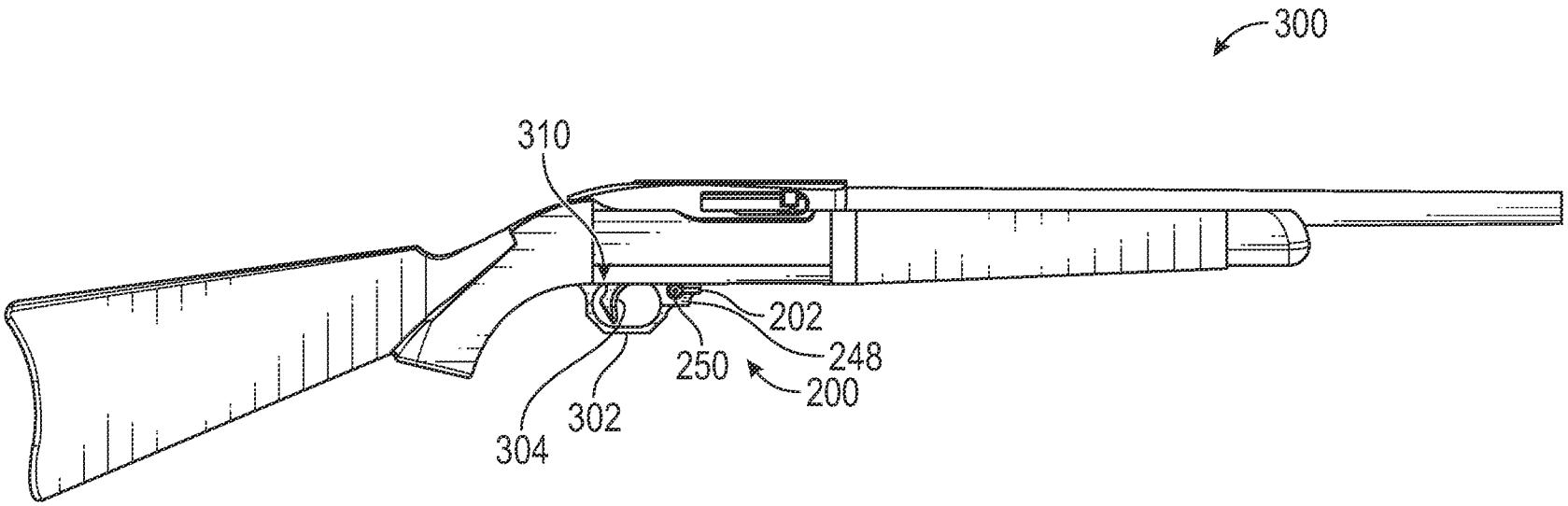
FIG. 2 is right side view of the current embodiment of a firearm control mechanism constructed in accordance with the principles of the present invention installed in a rifle.

FIG. 2 illustrates the improved firearm control mechanism 200 of the present invention. More particularly, the firearm control mechanism is shown installed in a rifle 300 adjacent to the trigger guard 302 and forward of the trigger 304. The trigger is connected to a frame 310 of the rifle and is movable with respect to the frame. The firearm control mechanism has a selector assembly 248 that is rotationally connected to the frame and pivotable with respect to the frame about a pivot axis 250. The selector assembly has a protruding right selector lever 202 to enable the user to rotate a selector shaft 204 (shown in FIGS. 3-11D) into a selected position to place the rifle in a desired mode of operation. Several different firing modes can be available depending on the characteristics of the rifle, including, but not limited to, safe, semi-automatic, multiple round burst, binary, and fully automatic. There may be a corresponding left selector lever 252 on the opposite side of the rifle (shown in FIG. 3) to facilitate ambidextrous operation of the rifle.

Figure 3:
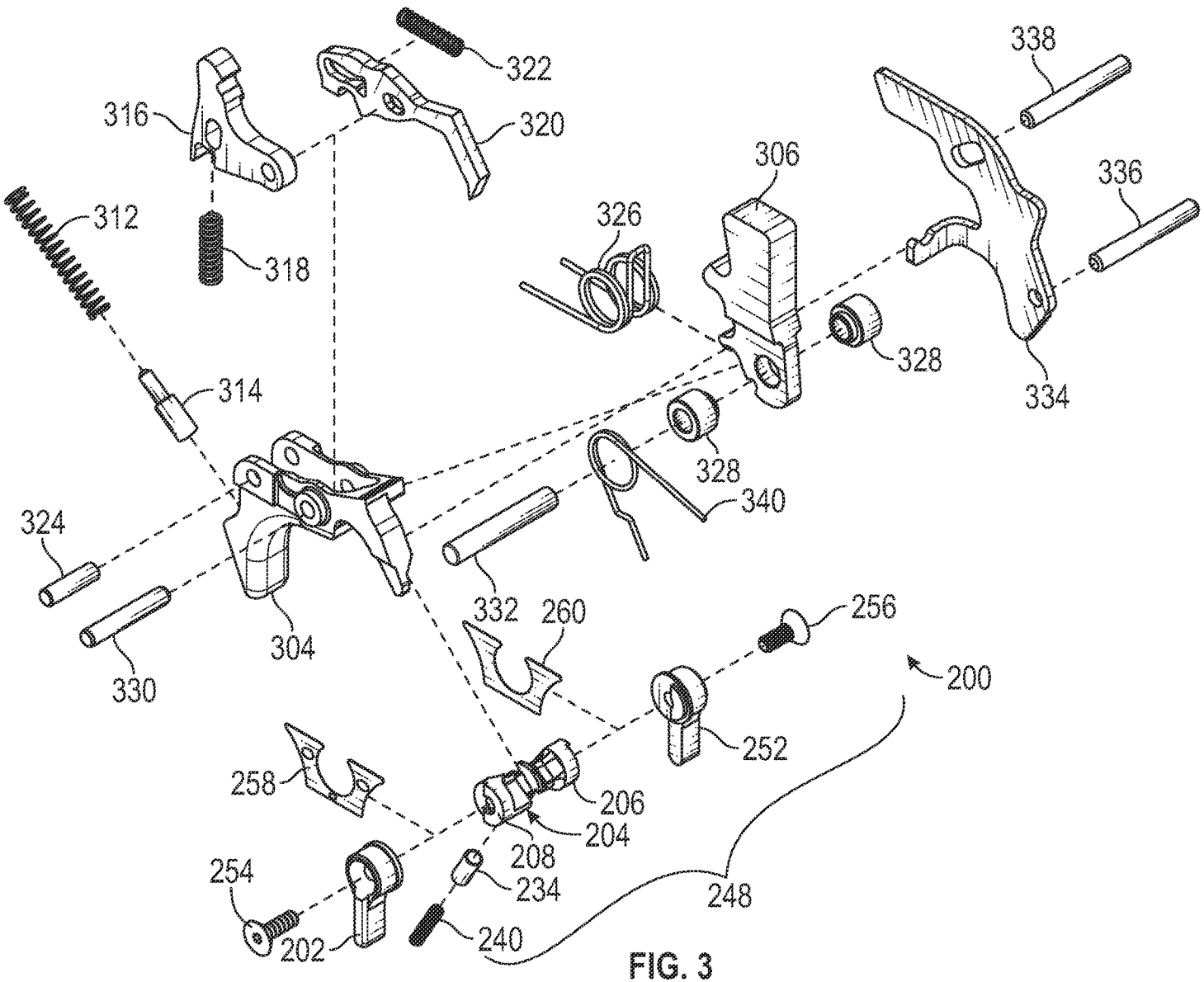
FIG. 3 is an exploded view of the firearm control mechanism of FIG. 1.

FIG. 3 illustrates the improved firearm control mechanism 200 of the present invention. More particularly, the firearm control mechanism has a selector assembly 248 that includes a selector shaft 204 having a left side 206 and a right side 208. A right selector lever 202 is connected to the right side of the selector shaft by a right selector screw 254. A left selector lever 252 is connected to the left side of the selector shaft by a left selector screw 256. A right selector label 258 and a left selector label 260 show the firing mode of the rifle 300 selected by the current position of the right and left selector levers and selector shaft. The selector assembly interacts with additional components installed in the frame 310 of the rifle 300 to form the fire control mechanism that determines the mode of operation of the rifle 300 based on the position of the selector assembly when the trigger 304 is pulled. The additional components include the trigger that is rotatably mounted on a trigger pin 330 and spring-biased into a forward position by a trigger spring 312 acting on a trigger spring plunger 314 that contacts the trigger. The additional components also include a disconnector 316 that is spring-biased in an upward direction by a disconnector spring 318, an intermittent disconnector spacer 320 receiving an intermittent disconnector spacer spring 322 and an intermittent disconnector spacer guide rod 324, a hammer 306 that is spring-biased into a forward position by a hammer spring 326 and rotatably mounted on hammer spacers 328 and a hammer pin 332. A fire control housing receives a magazine latch pivot 336 and an ejector pin 338 and is spring biased by a bolt catch pin 340.

Figure 4:
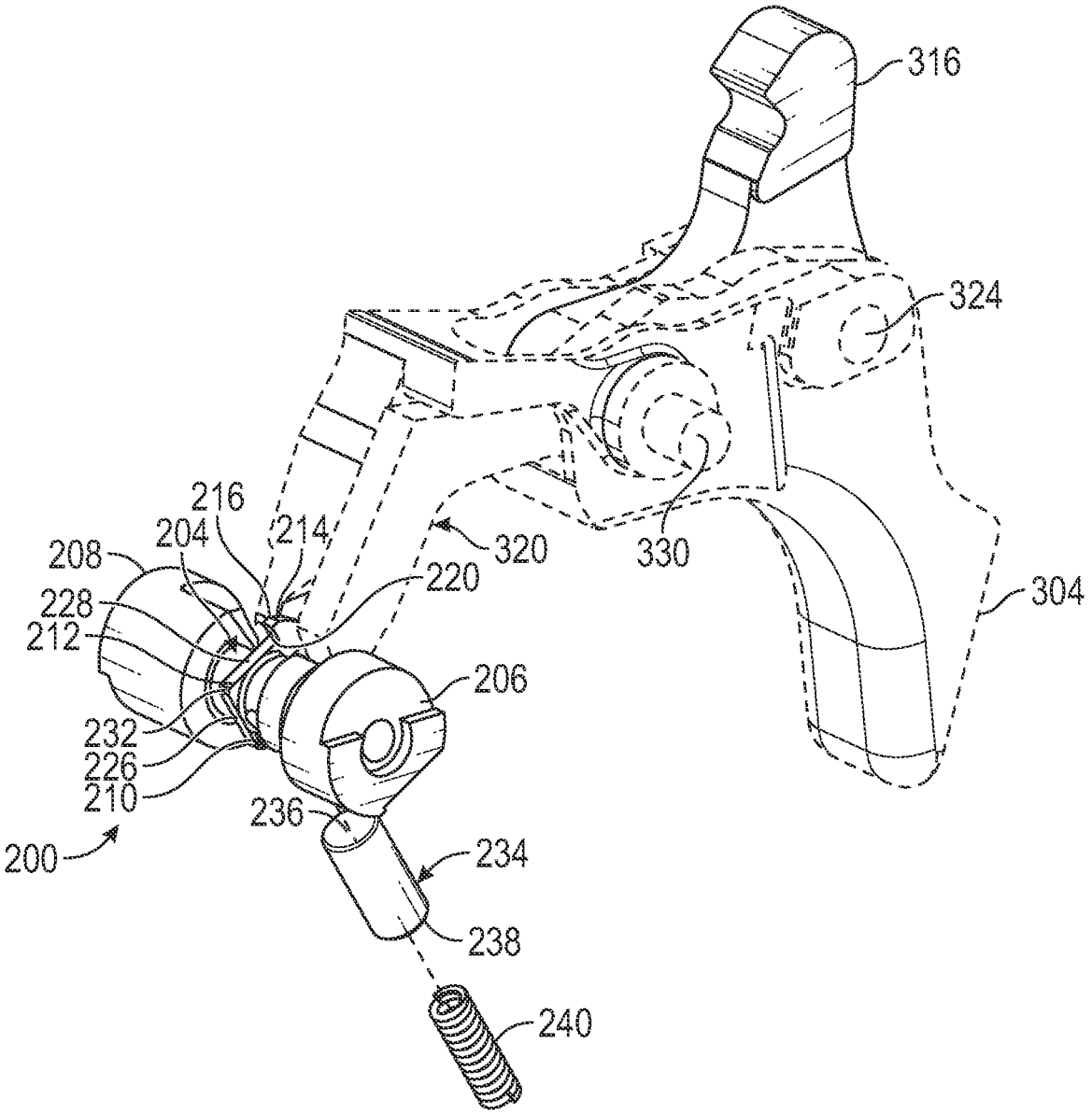
FIG. 4 is a front isometric view of a safety selector shaft of the selector of FIG. 1 along with a spring-loaded detent.
Figure 5:
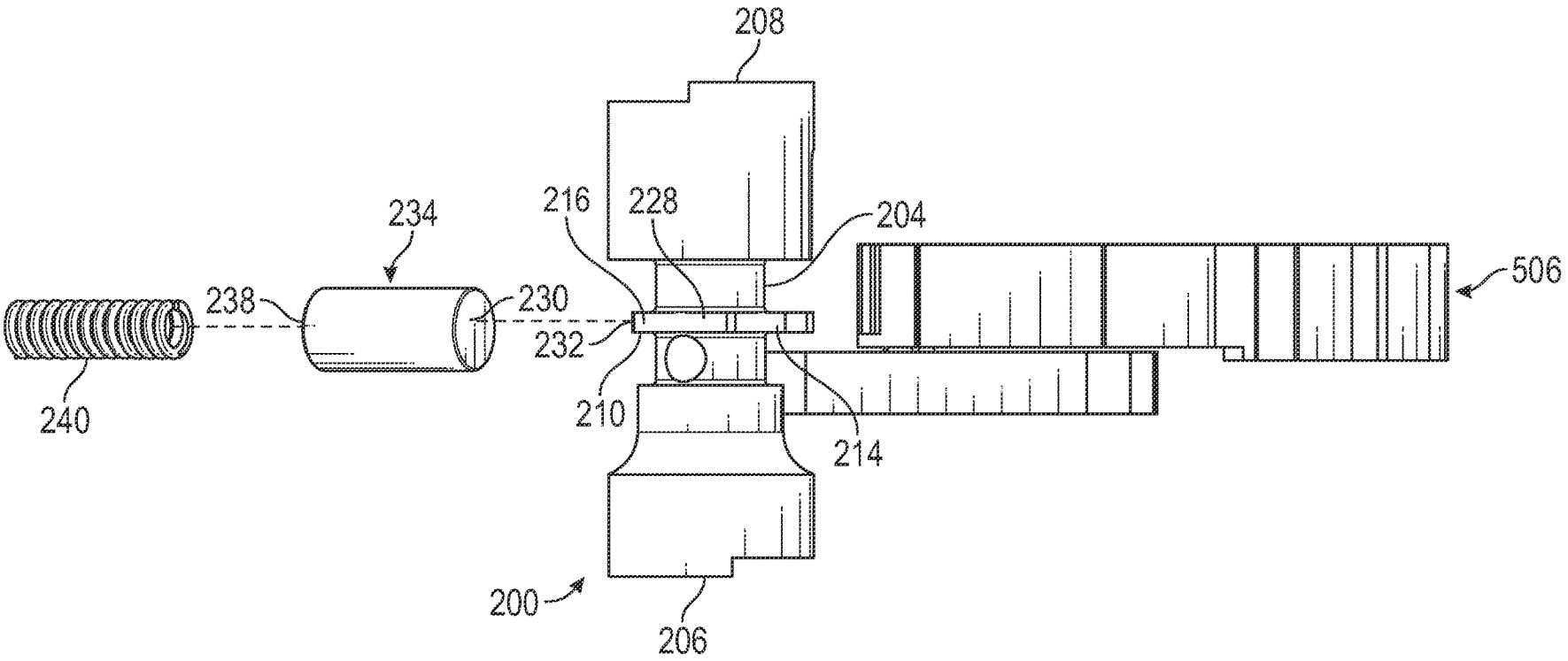
FIG. 5 is a front view of the safety selector shaft along with a spring-loaded detent.
Figure 6:
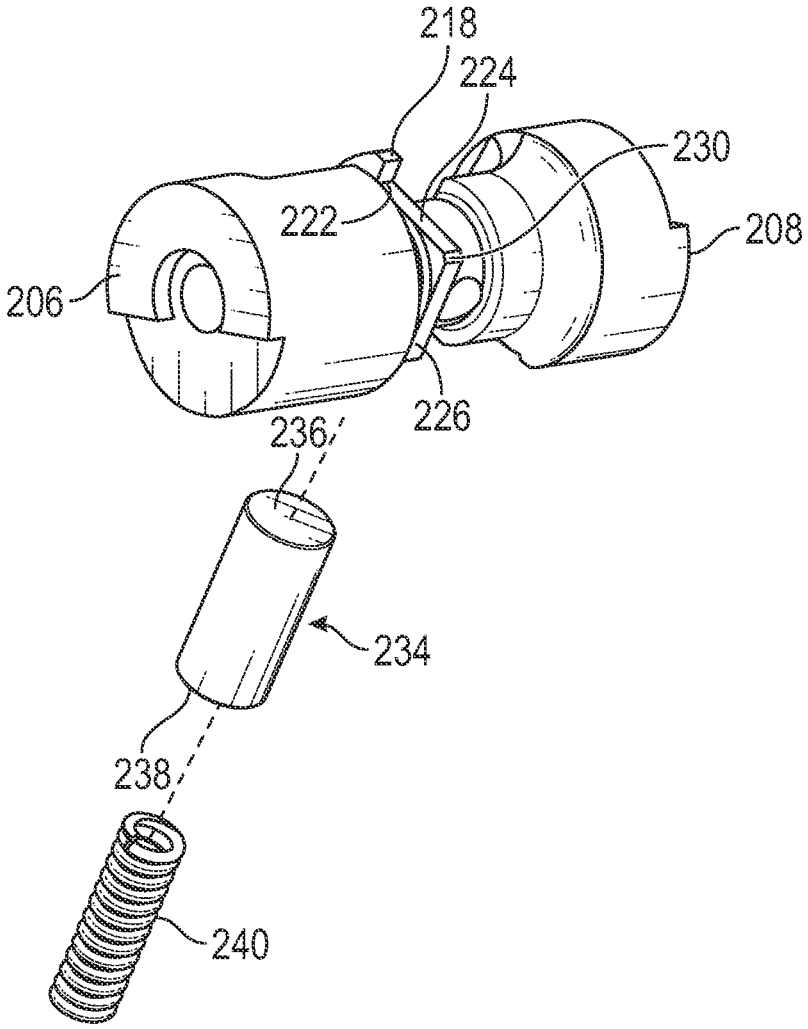
FIG. 6 is a front isometric view of the safety selector shaft along with a spring-loaded detent.

FIGS. 4-6 illustrate the improved selector shaft 204, detent 234, and spring 240 of the present invention. More particularly, the selector shaft has a left side 206 and a right side 208. The left and right sides are enlarged relative to the selector shaft and are adapted for attachment of right selector lever 202 and left selector lever 252. An intermediate portion of the selector shaft defines a selector 210. The selector 210 is a planar body having a square lower portion 212 and a rounded upper portion 214. The rounded upper portion has protruding ends 216, 218 that overhang the square lower portion and form right angles 220, 222. The square lower portion has three sides 224, 226, 228 that are each separated by an angled corner 230, 232. The fourth side of the square lower portion forms the rounded upper portion.

The spring-loaded detent 234 is a cylindrical body having a flat top 236 and a bottom 238. The spring 240 presses against the bottom and pushes the flat top against the selector 210. The elements shown in FIG. 4 in dashed lines are the trigger 304 pivotally mounted on trigger pin 330 and the disconnector 316 and intermittent disconnector spacer 320 mounted on the trigger pin 330 and intermittent disconnector spacer guide rod 324. These components determine the mode of operation of the rifle 300 based on the position of the selector shaft 204 when the trigger 304 is pulled. FIG. 5 includes the hammer 306.

Figure 7A:
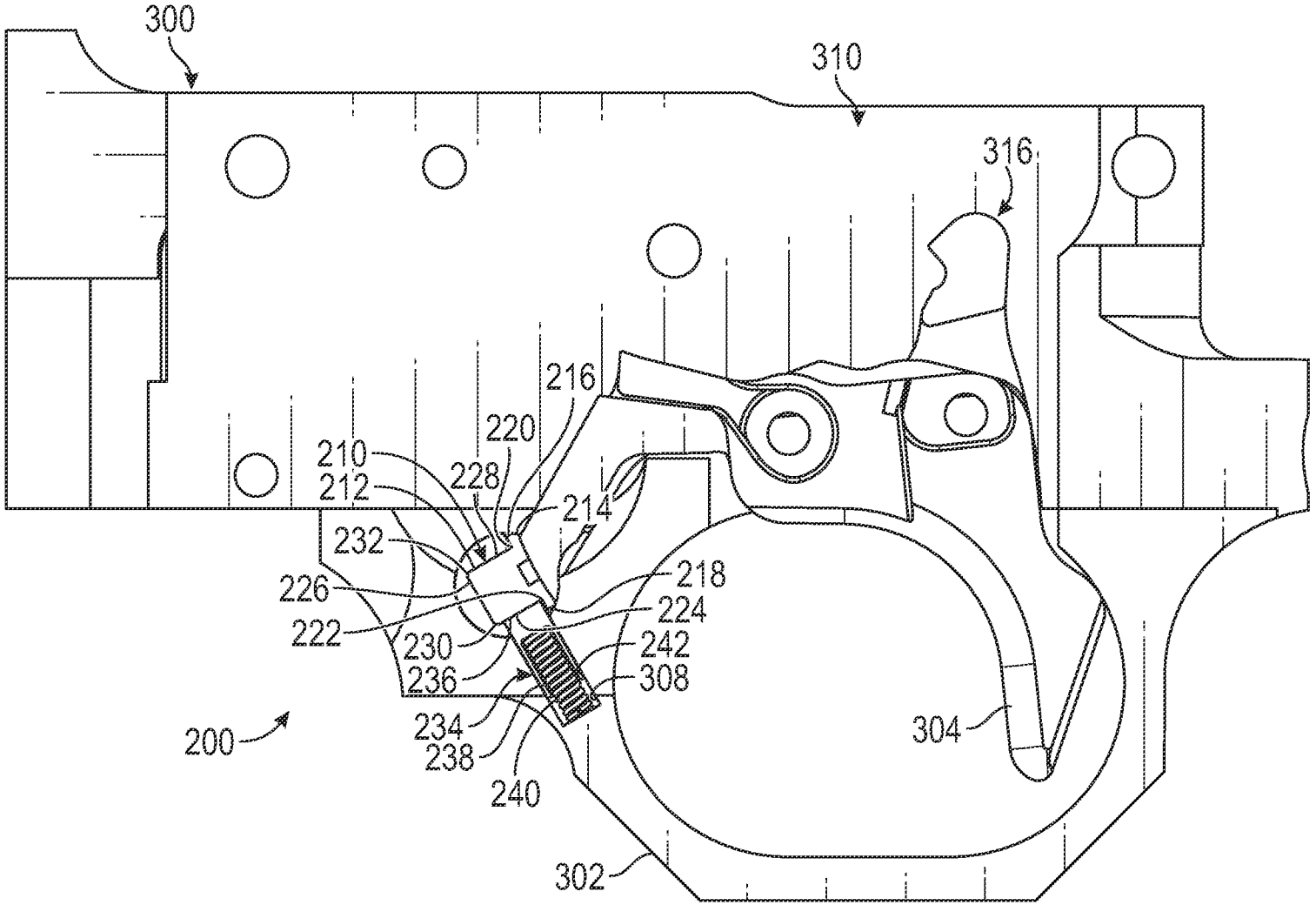
FIG. 7A is a side sectional view of the safety selector shaft and spring-loaded detent with the safety selector shaft selecting a first mode of operation.
Figure 7B:
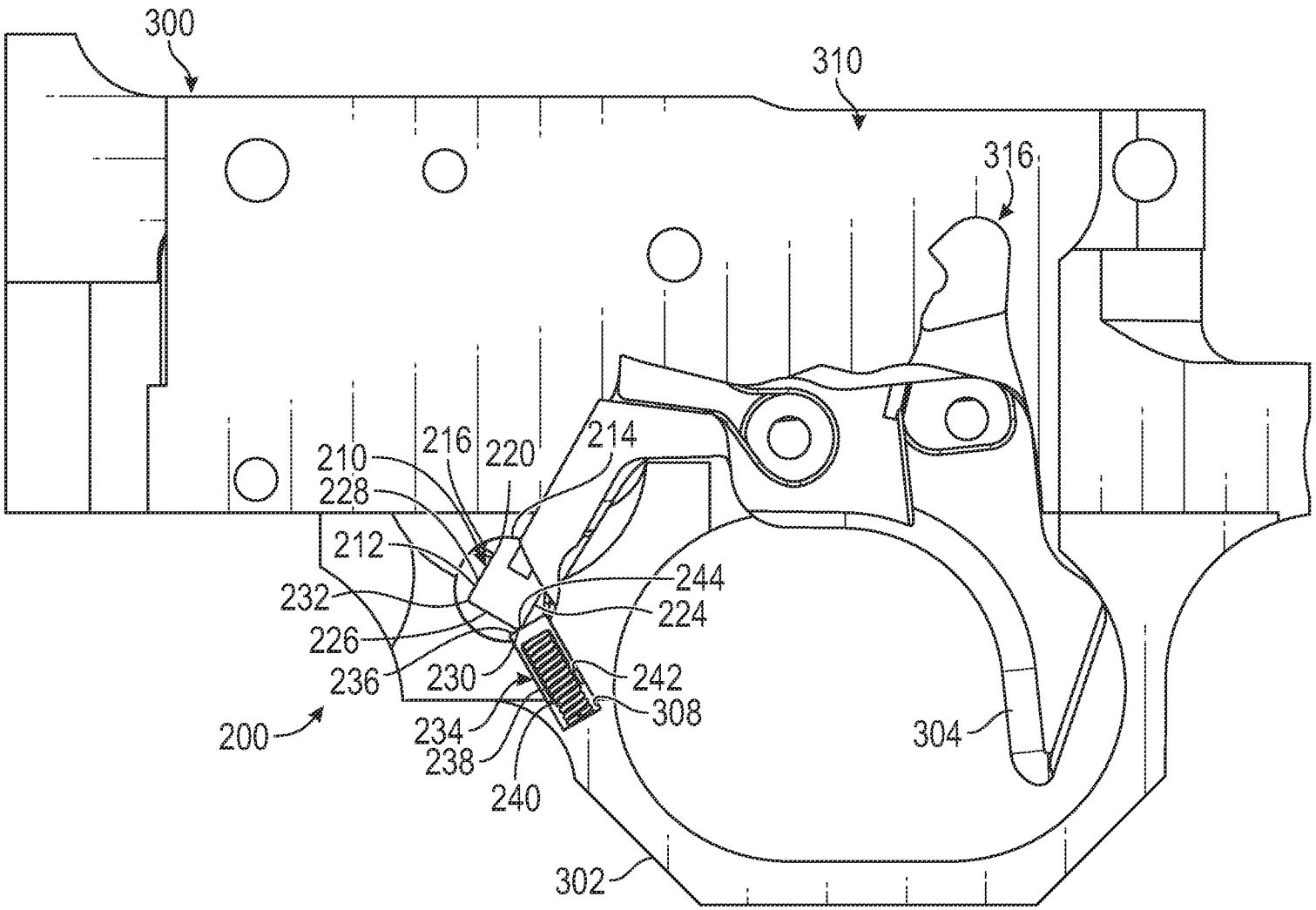
FIG. 7B is a side sectional view of the safety selector shaft and spring-loaded detent with the safety selector shaft having rotated counterclockwise relative to the position shown in FIG. 7A to begin transitioning to selecting a second mode of operation.
Figure 7C:
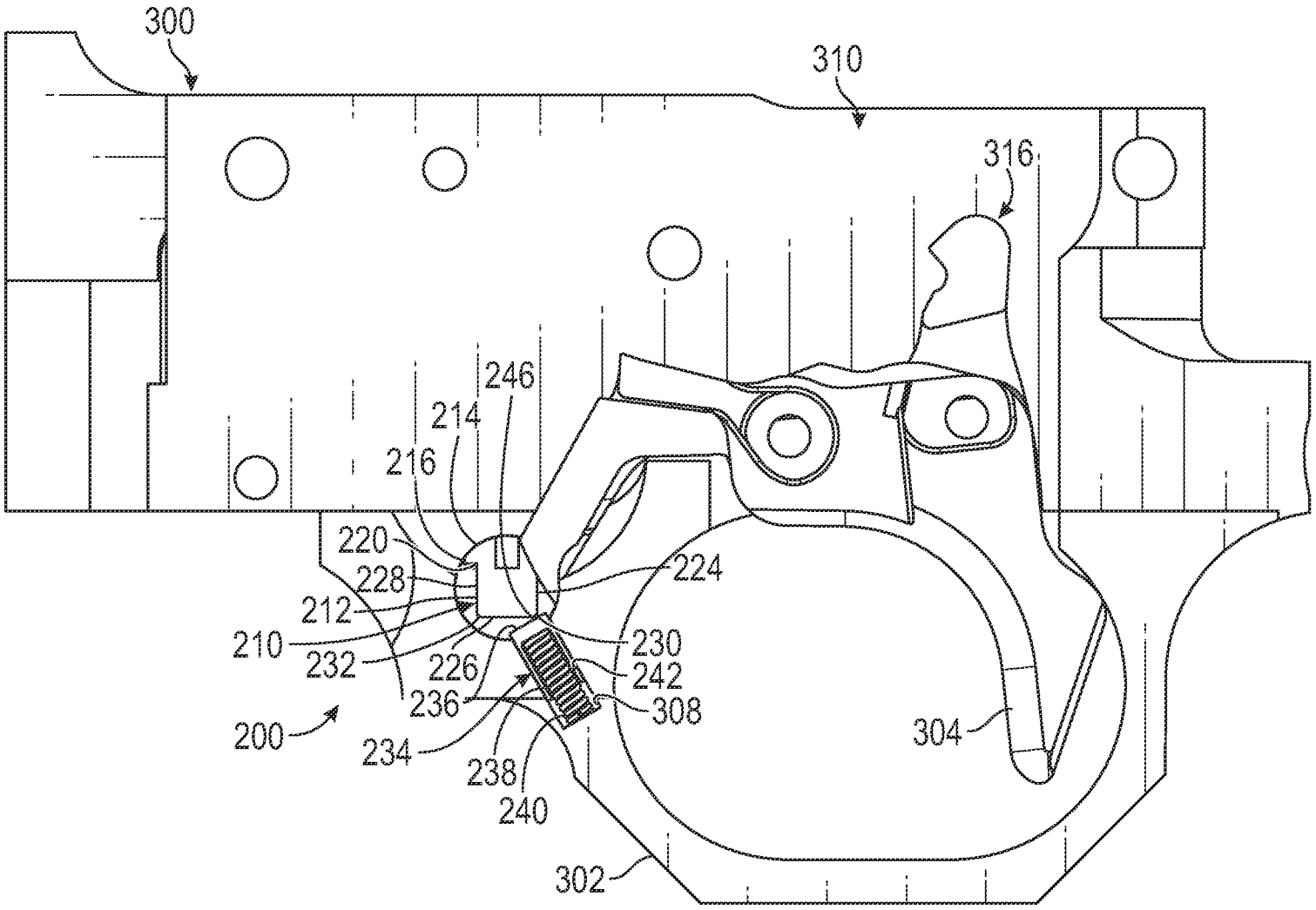
FIG. 7C is a side sectional view of the safety selector shaft and spring-loaded detent with the safety selector shaft having rotated counterclockwise relative to the position shown in FIG. 7B to further transition to selecting a second mode of operation.
Figure 7D:
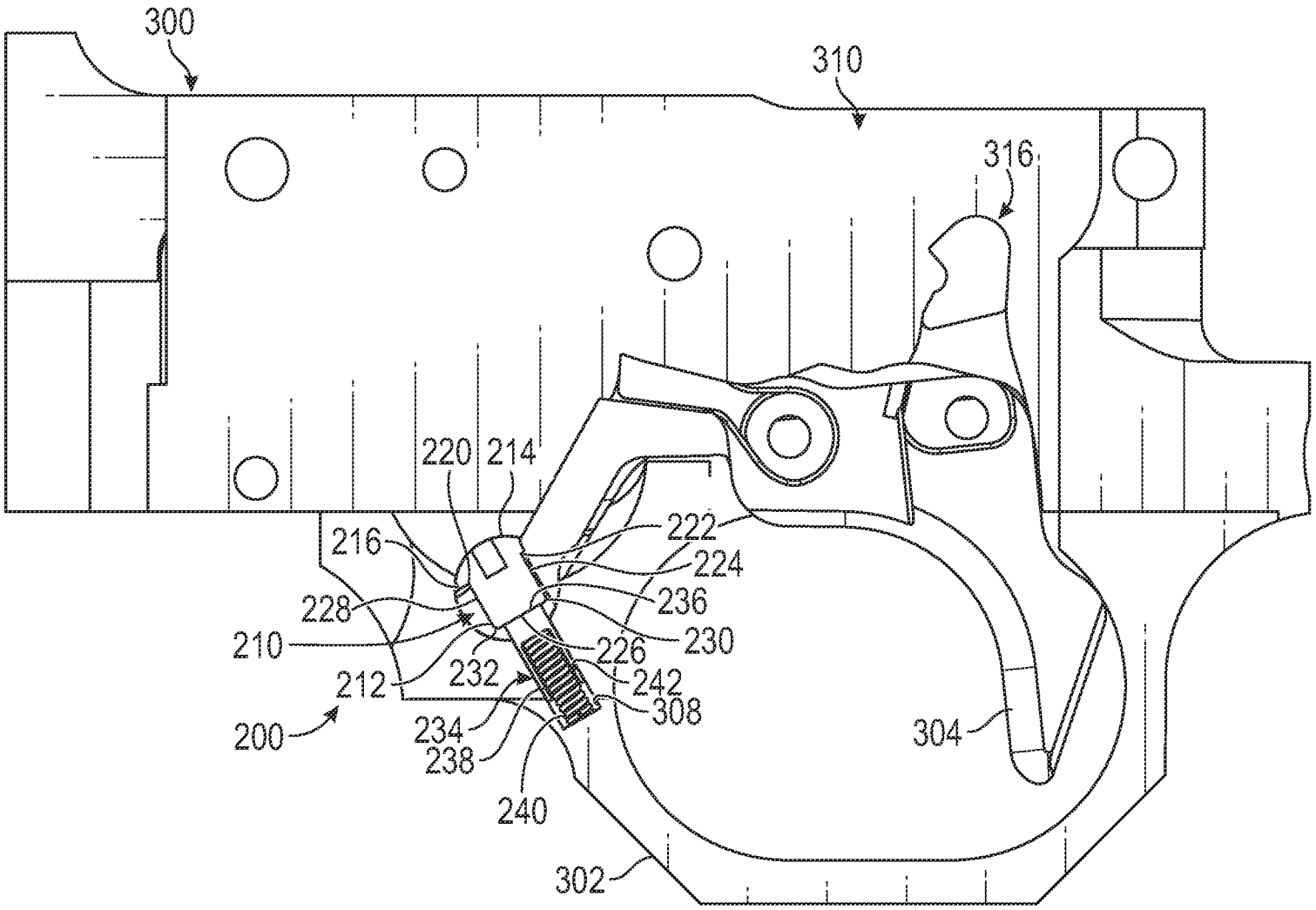
FIG. 7D is a side sectional view of the safety selector shaft and spring-loaded detent with the safety selector shaft having rotated counterclockwise relative to the position shown in FIG. 7C and 90° relative to the position shown in FIG. 7A to fully transition to selecting a second mode of operation.

FIGS. 7A-D illustrate the improved firearm control mechanism 200 of the present invention. More particularly, the firearm control mechanism is shown rotating counterclockwise 90° to transition the rifle 300 from a first mode of operation to a second mode of operation. In FIG. 7A, the rifle is shown in a first mode of operation. The spring 240 is received in a bore 308 in the rifle and a bore 242 defined by the bottom 238 of the spring-loaded detent 234. The spring urges the flat top 236 against the side 224 of the square lower portion 212 of the selector 210. The selector cannot be rotated further clockwise because of interference created by the protruding end 218 of the rounded upper portion 214. The selector cannot be rotated counterclockwise unless sufficient pressure is exerted to compress the spring and shift the spring-loaded detent out of the way. In FIG. 7B, sufficient pressure has been exerted to compress the spring and shift the spring-loaded detent out of the way such that the selector has rotated counterclockwise relative to the position shown in FIG. 7A so a forward portion 244 of the flat top of the spring-loaded detent is urged against the angled corner 230 of the selector. In FIG. 7C, sufficient pressure has been exerted to compress the spring and shift the spring-loaded detent out of the way such that the selector has rotated further counterclockwise relative to the position shown in FIG. 7B so a rearward portion 246 of the flat top of the spring-loaded detent is urged against the angled corner 230 of the selector. In FIG. 7D, sufficient pressure has been exerted to compress the spring and shift the spring-loaded detent out of the way such that the selector has rotated further counterclockwise relative to the position shown in FIG. 7B so the flat top of the spring-loaded detent is urged against the side 226 of the selector.

In the position shown in FIG. 7D, the selector 210 has rotated 90° counterclockwise relative to the position shown in FIG. 7A, thereby transitioning the rifle 300 from a first mode of operation to a second mode of operation. The selector cannot be rotated clockwise or counterclockwise unless sufficient pressure is exerted to compress the spring and shift the spring-loaded detent out of the way. The user has the option to rotate the selector further counterclockwise by 90° to transition the rifle from the second mode of operation to a third mode of operation, at which point the flat top 236 is urged against the side 228 of the selector, and further counterclockwise rotation of interference created by the protruding end 216 of the rounded upper portion 214. The user also has the option to rotate the selector clockwise by 90° to return the rifle to the first mode of operation.

The current invention includes at least the rotational selector 210, at least one linearly translating spring-loaded detent 234, and at least one spring 240 capable of imparting axial load onto the spring-loaded detent. The invention may also include one or more selector levers 202, 252 attached to the selector via the selector shaft 204, any receivers or frames 310 or structures that locate the selector and allow the selector to rotate about a pivot axis 250, any receivers or frames or structures that locate the spring-loaded detent and allow the spring-loaded detent to translate normal to or at an angle to the selector, any receivers or frames or structures that locate the spring such that the spring is able to impart a linear force onto the spring-loaded detent, and any other pieces connected to or rotating with the selector (such as a multi-piece selector).

The flat top 236 of the spring-loaded detent 234 is shaped such that the surface that contacts the sides 224, 226, 228 of the selector 210 is normal to the axial line of motion of the spring-loaded detent. There is also a corresponding surface or series of surfaces on the sides of the selector.

These surfaces on the sides of the selector are parallel to a theoretical tangential plane on the selector's radius of rotation (Rn). The surfaces on the sides of the selector are offset by some distance (Rf) such that rotating the selector rotates the surfaces on the sides of the selector and causes the spring-loaded detent to translate along its axial axis by a distance $Rd=Rf*(\sec(\Theta)-1)$ where Rd is the displacement distance of the spring-loaded detent, Rf is the distance from the centerline of rotation to a selected surface on a side of the selector, and $\Theta$ is the angle from the normal vector of the a selected surface on a side of the selector to the edge of the selected surface on a side of the selector and is generally smaller than 90°. This allows the spring-loaded detent to constrain the angle of the selector by imparting a normal force from the spring-loaded detent surface to the selected surface on a side of the selector, which generally travels through the centerline of the selector. The translational displacement of the spring-loaded detent when the selector is rotated will provide resistance until the selector is rotated greater than $\Theta$ and will aid in the rotation of the selector until it is normal to another selected surface on a side of the selector.

The selector 210 can be made from a variety of materials including metals (steel, aluminum, titanium, etc.), polymers, plastics, composites, and/or ceramics. The selector can be manufactured by machining, turning, casting, injection-molding, forming, or abrasive cutting. The spring-loaded detent can be made out of a variety of materials, including metals, polymers, plastics, composites, and/or ceramics, and is generally round, but can also be any other shape capable of translating axially while being constrained laterally. The spring-loaded detent can be manufactured by machining, turning, casting, injection-molding, forming, or extruding. The spring-loaded detent may also have a feature such as a slot or shelf that limits its axial translation but still allows the selector detent surface to contact the selected surface on a side of the selector.

The current invention's interface between the selector 210 and the spring-loaded detent 234 is different from other common selector-selector detent interfaces for a variety of reasons. It allows the selector to be biased towards the position it is angularly closest to, with the amount of bias depending on how large the selected surface on a side of the selector is and the angle between the sides of the selector. It also greatly improves manufacturability, replacing conical or hemispherical notches and V-shaped grooves with simple flat surfaces that are more easily manufactured and inspected. In some applications, this design can even aid in installation if the installer needs to depress the spring-loaded detent against the spring 240 using a punch.

Figure 8:
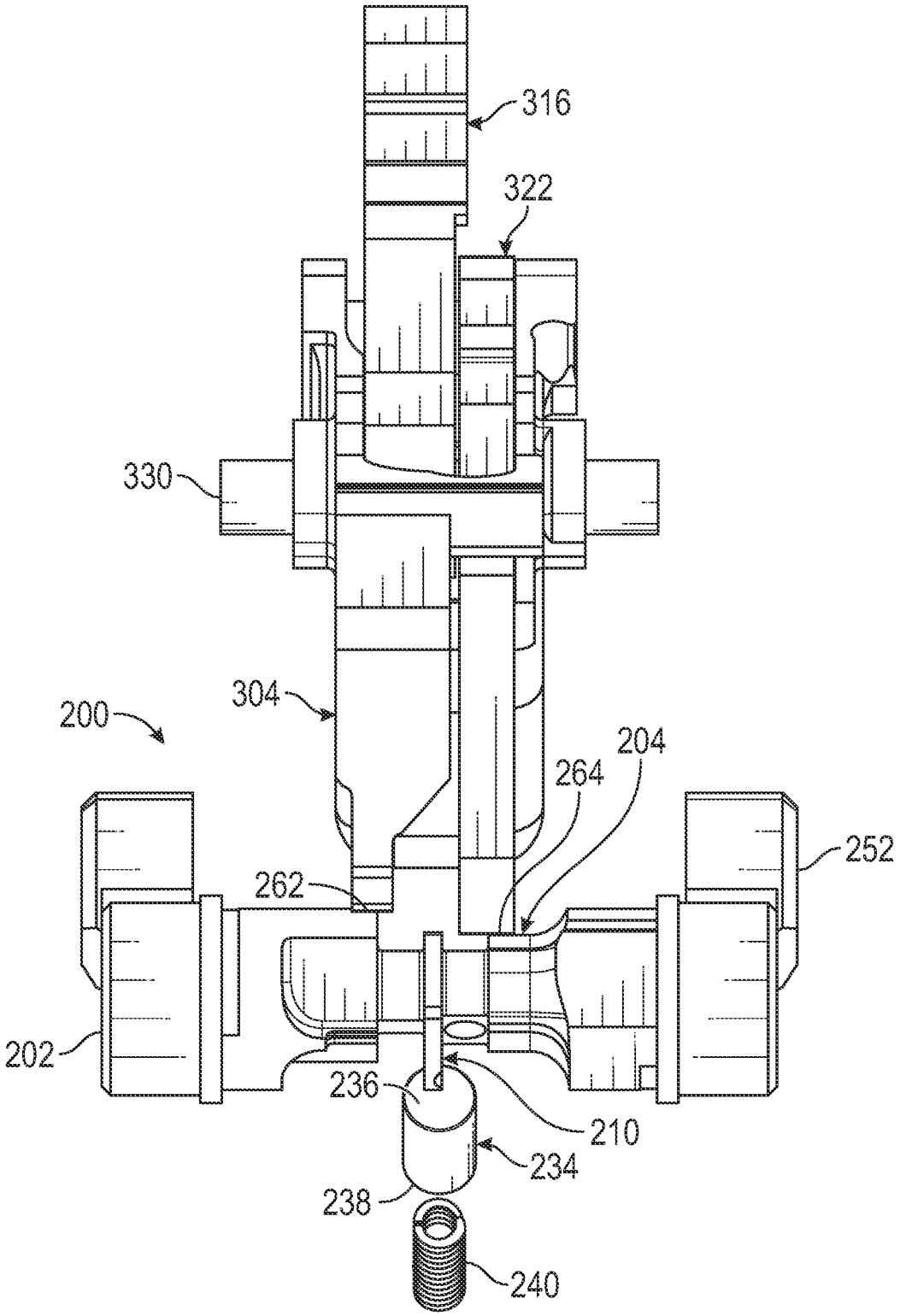
FIG. 8 is a front view of the safety selector shaft along with a spring-loaded detent.
Figure 9:
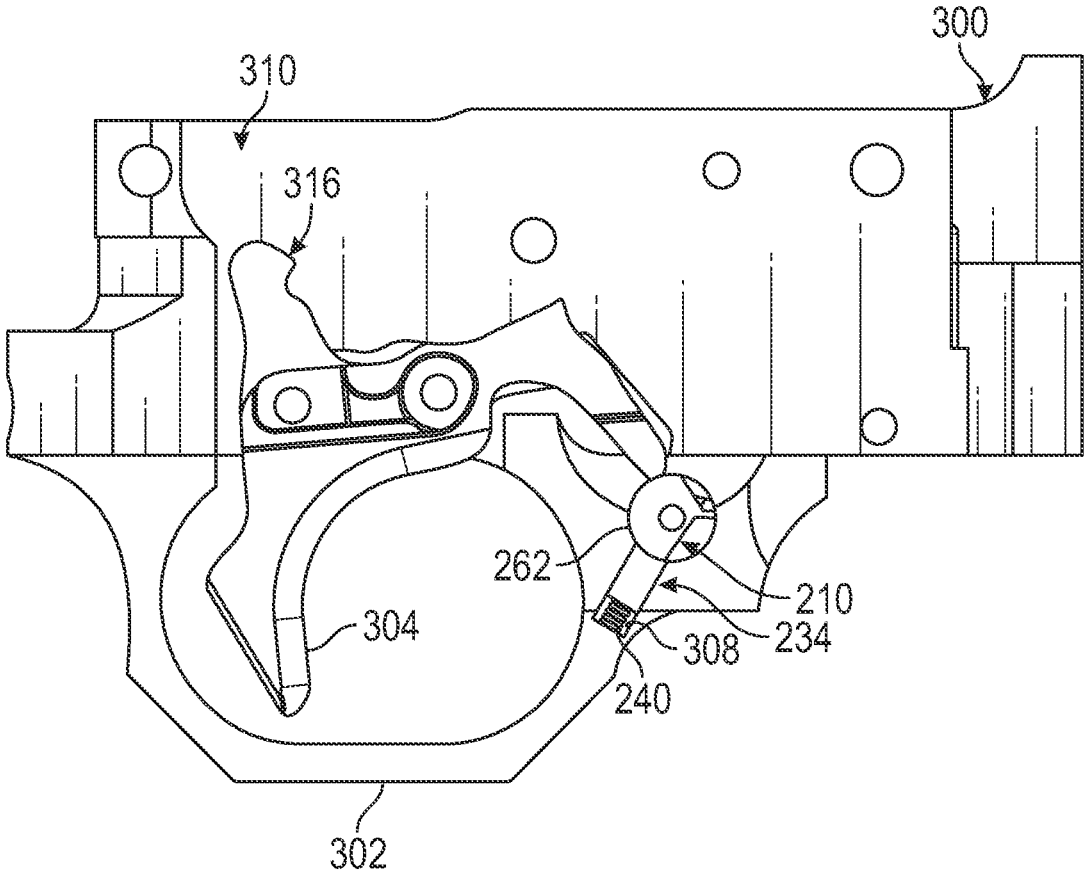
FIG. 9 is a side sectional view of the safety selector shaft and spring-loaded detent installed in a rifle.
Figure 10:
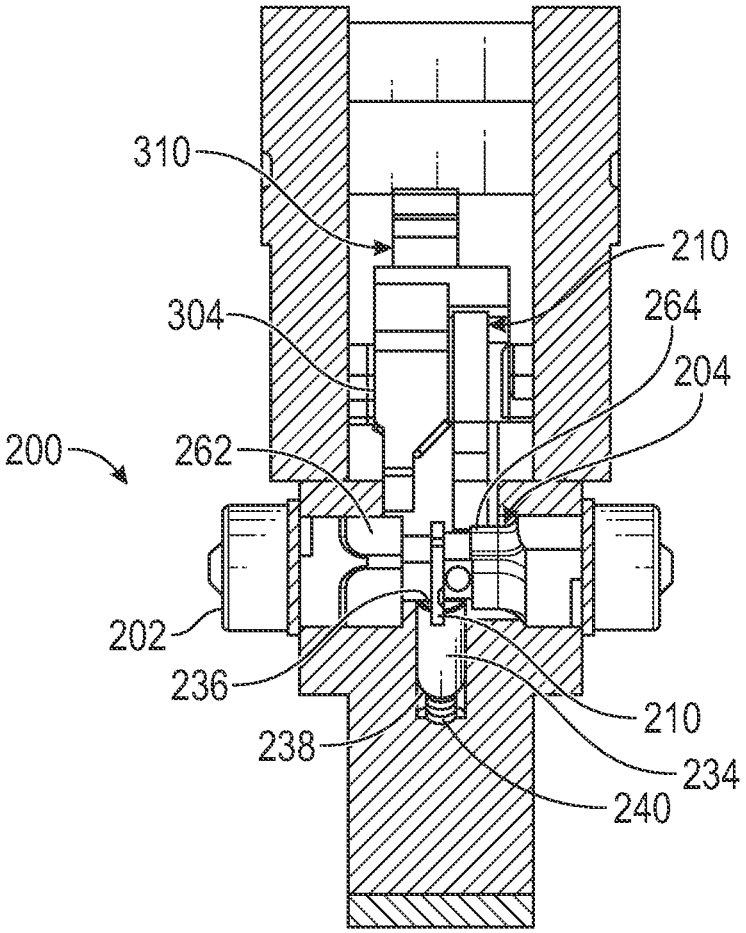
FIG. 10 is a front sectional view of the safety selector shaft and spring-loaded detent installed in a rifle.

FIGS. 8-10 illustrate the improved firearm control mechanism 200 of the present invention. More particularly, the selector assembly for firearms is shown with the selector shaft 204 in the safe position. With the selector shaft in this position, the trigger camming surface 262 blocks clockwise rotation of the trigger 304, thereby preventing the trigger from being pulled to discharge the rifle 300.

Figure 11:
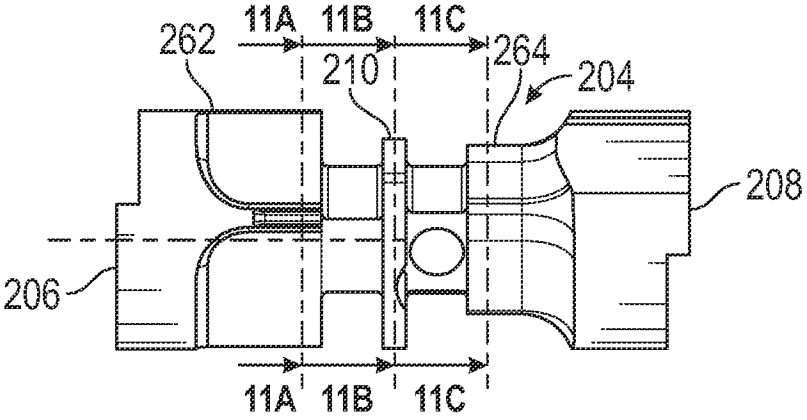
FIG. 11 is a top view of the safety selector shaft.
Figure 11C:
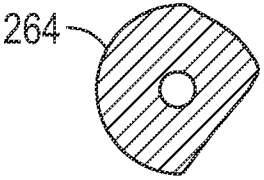
FIG. 11C is a side sectional view taken along line 11C-11C of FIG. 11.
Figure 11B:
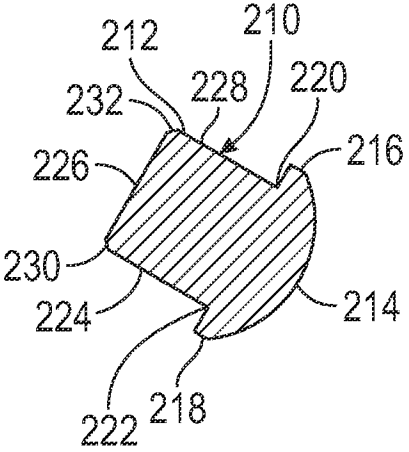
FIG. 11B is a side sectional view taken along line 11B-11B of FIG. 11.
Figure 11A:
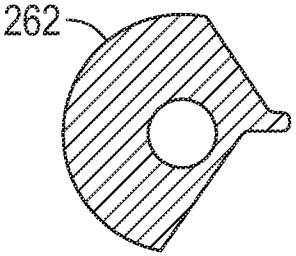
FIG. 11A is a side sectional view taken along line 11A-11A of FIG. 11.
Figure 11D:
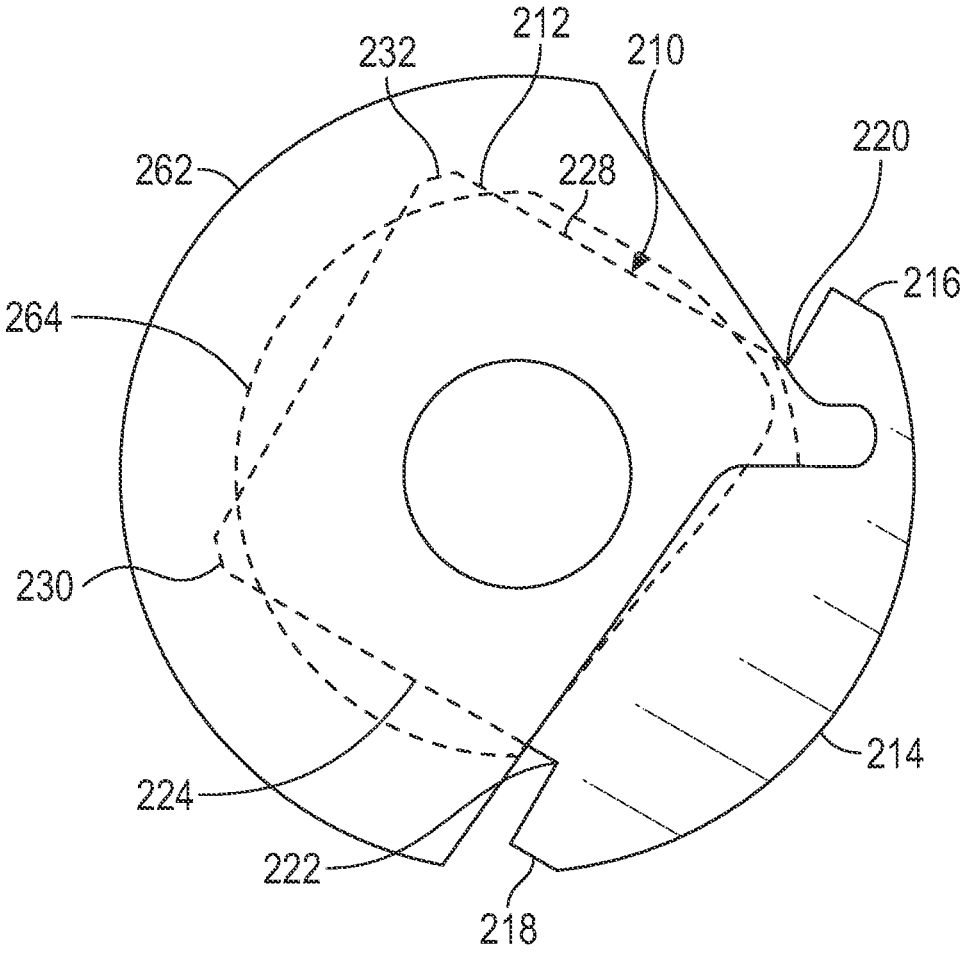
FIG. 11D is a side sectional view of the sections in FIGS. 11A-11C overlaid in axial registration with one another.

FIGS. 11-11D illustrate the improved selector shaft 204 of the present invention. More particularly, enlarged sectional views of the trigger camming surface 262, selector 210, and intermittent disconnector spacer camming surface 264 are provided so the details of their surface profiles can be fully appreciated. The trigger camming surface is a first cam surface of the selector shaft 204 operably engaged to a follower portion of the trigger 304. The selector has a detent portion (square lower portion 212) of the selector shaft having a detent surface (sides 224, 226, 228 of the selector) opposing a spring-biased detent follower (detent 234) connected to the frame 310 and operable to reciprocate against the detent surface. The detent surface has a plurality of stable positions (sides 224, 226, 228 of the selector), each corresponding to an operating condition of the fire control mechanism 200. The detent portion lacks any concave surfaces in the current embodiment. The detent surface has a plurality of flat cam surfaces (sides 224, 226, 228 of the selector), at least two of which are perpendicular to each other. A corner (angled corners 230, 232) joins the plurality of flat cam surfaces. The detent follower has a flat face (flat top 236) contacting the detent surface. The detent surface includes a plate having peripheral edges (square lower portion 212) facing away from the pivot axis 250. The detent surface is spaced apart from the first cam surface. The intermittent disconnector spacer camming surface 264 is a second cam surface of the selector shaft. The detent surface is between the first cam surface and the second cam surface. The detent portion has only flat and convex surface portions. The detent portion is a planar body perpendicular to the pivot axis. The detent surface is a peripheral surface of the detent portion. At least a portion of the detent surface extends radially from the pivot axis by a greater amount than angularly corresponding portion of the first cam surface. The detent portion lacks any recesses.

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm.

While a current embodiment of a firearm control mechanism has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm control mechanism comprising:

a frame;

a trigger element connected to the frame and movable with respect to the frame;

a selector connected to the frame and pivotable with respect to the frame about a pivot axis;

the selector including a first cam surface operably engaged to a follower portion of the trigger element;

the selector having a detent portion having a detent surface opposing a spring biased detent follower connected to the frame and operable to reciprocate against the detent surface;

the detent surface having a plurality of stable positions, each corresponding to an operating condition of the fire control mechanism;

the selector including a stop surface limiting the selector to a limited range of pivoting; and the detent portion being a body lacking any concave surfaces.

2. The firearm control mechanism of claim 1 including the detent surface having a plurality of flat cam surfaces.

3. The firearm control mechanism of claim 2 wherein at least two of the flat cam surfaces are adjacent and non-coplanar to each other.

4. The firearm control mechanism of claim 2 including a corner joining the plurality of flat cam surfaces.

5. The firearm control mechanism of claim 1 the detent follower having a flat face contacting the detent surface.

6. The firearm control mechanism of claim 1 the detent surface including a plate having peripheral edges facing away from the pivot axis.

7. The firearm control mechanism of claim 1 wherein the detent surface is spaced apart from the first cam surface.

8. The firearm control mechanism of claim 1 wherein the selector includes a second cam surface.

9. The firearm control mechanism of claim 8 wherein the detent surface is between the first cam surface and the second cam surface.

10. The firearm control mechanism of claim 1 wherein the detent portion having only flat and convex surface portions.

11. The firearm control mechanism of claim 1 wherein the detent portion is a planar body perpendicular to the pivot axis.

12. The firearm control mechanism of claim 1 wherein the detent surface is a peripheral surface of the detent portion.

13. The firearm control mechanism of claim 1 wherein at least a portion of the detent surface extends radially from the pivot axis by a greater amount than an angularly corresponding portion of the first cam surface.

14. The firearm control mechanism of claim 1 wherein the detent portion lacks any recesses.

15. The firearm control mechanism of claim 2 wherein at least two of the flat cam surfaces are perpendicular to each other.

* * * * *